United States Patent [19]
Smith et al.
[11] 4,290,476
[45] Sep. 22, 1981

[54] NOZZLE GEOMETRY FOR PLANAR FLOW CASTING OF METAL RIBBON

[75] Inventors: Robert W. Smith, Long Valley; Naim S. Hemmat, Mendham; John R. Bedell, Madison; Sheldon Kavesh, Whippany; Seymour Draizen, Old Bridge, all of N.J.

[73] Assignee: Allied Chemical Corporation, Morris Township, Morris County, N.J.

[21] Appl. No.: 112,006

[22] Filed: Jan. 14, 1980

[51] Int. Cl.[3] ..... B22D 11/06
[52] U.S. Cl. ..... 164/423; 164/463; 164/481
[58] Field of Search ..... 164/87, 423, 427, 429, 164/437

[56] References Cited

U.S. PATENT DOCUMENTS 4,142,571 3/1979 Narasimhan ..... 164/87 X
4,177,856 12/1979 Liebermann ..... 164/87
4,212,343 7/1980 Narasimhan ..... 164/87 X

*Primary Examiner*—Robert D. Baldwin
*Assistant Examiner*—K. Y. Lin
*Attorney, Agent, or Firm*—James Riesenfeld; Gerhard H. Fuchs

[57] ABSTRACT

An apparatus is provided for planar flow casting of metal ribbon. The apparatus comprises a movable chill surface, a reservoir for holding molten metal and a slotted nozzle whose lips are located close to the chill surface. In operation, molten metal is forced through the nozzle onto the chill surface to form a melt puddle. Rapid cooling of the molten metal results in the formation of a continuous ribbon. The nozzles of this invention provide a planar bottom surface which includes the leading edge of the first lip and the side edges at the bottom of the lips and which is as close or closer to the chill surface than is any other point on the lips. The nozzle reduces air flow around the melt puddle and thereby improves ribbon uniformity.

9 Claims, 16 Drawing Figures

NOZZLE GEOMETRY FOR PLANAR FLOW CASTING OF METAL RIBBON

BACKGROUND OF THE INVENTION

1. Field of the Invention

This invention relates to apparatus for planar flow casting of metal ribbon, particularly ribbon of amorphous metal alloys.

2. Description of the Prior Art

For purposes of the present invention, a ribbon is a slender body of substantially rectangular cross section whose transverse dimensions are much smaller than its length.

Apparatus for preparing continuous metal ribbon from the melt by the planar flow casting method is disclosed, inter alia, in U.S. Pat. No. 4,142,571, issued Mar. 6, 1979 to Narasimhan. The disclosure of this patent is incorporated herein by reference. It provides apparatus which comprises a movable chill body, a slotted nozzle in communication with a reservoir for holding molten metal and means for effecting expulsion of the molten from the reservoir through the nozzle onto the moving chill surface.

The slotted nozzle is located in close proximity to the chill surface. Its slot is oriented perpendicular to the direction of movement of the chill surface and is defined by a pair of generally parallel lips, a first lip and a second lip numbered in the direction of movement of the chill surface. The slot has a width, measured in the direction of movement of the chill surface, of about 0.2 to 1 mm. There is no limitation on the length of the slot (measured perpendicular to the direction of movement of the chill surface) other than the practical consideration that the slot should not be longer than the width of the chill surface. The length of the slot determines the width of the strip or sheet being cast.

The first lip has a width (measured in the direction of movement of the chill surface) at least equal to the width of the slot. The second lip has a width of about 1.5 to 3 times the width of the slot. The gap between the lips and the chill surface is at least about 0.1 times the width of the slot, but may be large enough to equal the width of the slot.

As the molten metal is forced onto the chill surface, a molten puddle is formed. The puddle extends a short distance upstream, forming a meniscus extending between the chill surface and the first lip of the nozzle. It has been discovered that a unique equilibrium position for the meniscus does not exist when the first lip consists of a single plane surface parallel to the chill surface as is disclosed in the prior art. Variations in the meniscus position (i.e., distance from the slot) give rise to undesirable variations in the dimensions of the cast product.

Ribbon prepared by the casting methods of the prior art often suffer from wavy and uneven edges caused by turbulent air movement over the surface and sides of the molten metal. For chill block melt-spinning, the parameters of this problem were recognized in U.S. Pat. No. 4,144,926, issued on Mar. 20, 1979, to H. H. Liebermann. It is not clear that the Liebermann's conclusions are applicable to planar flow casting. In any case, no nozzle configuration has been suggested that would provide the uniform ribbon surface and even edges that are desirable.

Air flow in the vicinity of the molten metal puddle can also cause defects in the bottom surface and in the body of the ribbon. These are created when air is trapped between the molten metal puddle and the chill surface. Trapped air can caused uneven bottom surface and/or voids in the body of the ribbon. Also, to the extent that entrapped air reduces the area of molten metal contact with the chill surface, quench rate is reduced, which is particularly undesirable when amorphous or metastable ribbon is being cast.

Although these problems can be mitigated by casting under a vacuum (see e.g., U.S. Pat. No. 4,154,283, issued May 15, 1979, to R. Ray et al.), casting in air is more convenient.

SUMMARY OF THE INVENTION

In accordance with the present invention, an apparatus for planar flow casting of metal ribbon is provided. The apparatus comprises a movable chill surface, a reservoir for holding molten metal and a nozzle in communication at its top with the reservoir and having at its bottom two lips adjacent to the chill surface, a first lip and a second lip numbered in the direction of movement of the chill surface. The lips are separated by and define a slot for depositing molten metal on the chill surface. The leading and trailing edges of the slot are substantially parallel and are generally perpendicular to the direction of movement of the chill surface. The bottom of the lips comprises at least two surfaces, including a substantially planar first surface substantially parallel to the chill surface. This first surface includes the leading edge of the first lip and the side edges at the bottom of the lips but does not include the trailing edge of the slot. The first surface is separated from the chill surface by at least about 0.02 mm, and all points on the bottom of the lips are at least as far from the chill surface as is the first surface but are no further from the chill surface than about 1 mm.

Locations on the apparatus are conveniently described in relation to the direction of motion of the chill surface. Thus, as the chill surface moves, it passes first under the first lip, then the second lip; first under the leading edge, then the trailing edge; first under upstream locations, then downstream.

The chill surface of the invention may be substantially flat, such as a belt, or it may be an annular chill roll. Since the width of the bottom of the nozzle in the direction of travel of the chill surface is small compared with the radius of the chill roll, for convenience, the chill roll may be considered to approximate a plane beneath the nozzle over the width of the nozzle. When the chill surface is a belt or similar flat surface no such approximation is necessary.

For convenience, the apparatus is described as if it were oriented vertically, with the chill surface located below the reservoir and nozzle; however, as is clear to one skilled in the art, the apparatus may also be oriented with the chill surface positioned horizontally adjacent to, or even above, the nozzle. Of course, the apparatus may also be oriented in a direction between horizontal and vertical.

DETAILED DESCRIPTION OF THE INVENTION

The apparatus of this invention permits the continuous casting of metal ribbon of controlled contour. The apparatus is an improvement over that described in U.S. Pat. No. 4,142,571, in which is disclosed the method and apparatus of planar flow casting.

Figure 1:
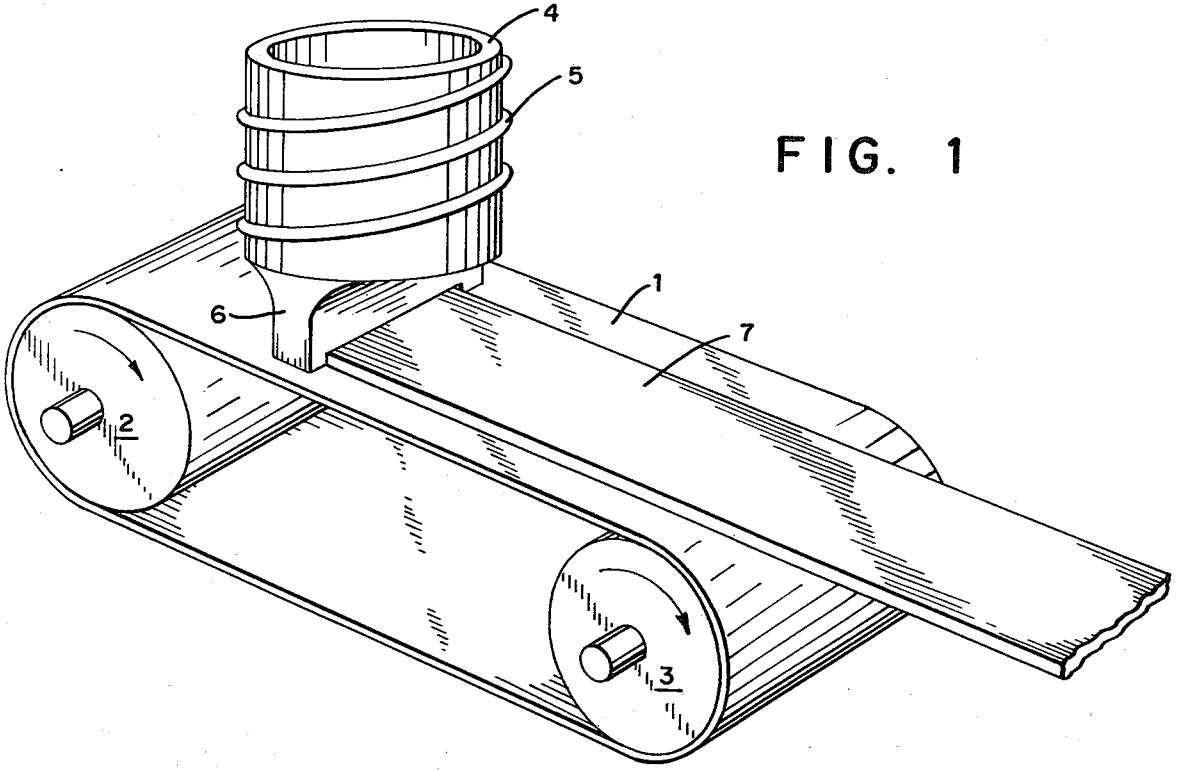
FIG. 1 is a simplified perspective view of the apparatus of this invention in an embodiment where the chill surface is an endless moving belt.

In the FIGS. described below, corresponding elements have the same identifying numerals. FIG. 1 shows a simplified perspective view of a planar flow casting apparatus of this invention. In the embodiment shown the chill body is an endless belt 1 which is placed over rolls 2 and 3 which are caused to rotate by external means (not shown). Molten metal is provided from reservoir 4, equipped with means (not shown) for pressurizing the molten metal therein by gas over-pressure, head pressure of molten metal or the like. Molten metal in reservoir 4 is heated by electrical induction heating coil 5. Reservoir 4 is in communication with nozzle 6 equipped with a slotted orifice. In operation, belt 1 is moved at a predetermined longitudinal velocity that is ordinarily at least about 200 meters per minute. Molten metal from reservoir 4 is pressurized to force it through nozzle 6 into contact with belt 1, whereon it is solidified into a solid strip 7 and separated from belt 1 by means not shown.

Instead of endless belt 1, the chill body may be an annular wheel rotatably mounted on its longitudinal axis. The chill surface may be of any metal having relatively high thermal conductivity, such as copper. High thermal conductivity is particularly important if it is desired to make amorphous or metastable strips. Preferred materials of construction include beryllium copper and oxygen-free copper. If desired, the chill surface may be highly polished or may be provided with a highly uniform surface, such as chrome plate, to enhance the bottom surface smoothness of the ribbon. To provide protection against erosion, corrosion or thermal fatigue, the surface of the chill body may be coated with a suitable resistant or high-melting coating. For example, a ceramic coating or a coating of corrosion-resistant high-melting metal may be applied by known procedures, provided that in each case the wettability of the molten metal on the chill surface is adequate.

In short run operation, it is not ordinarily necessary to provide cooling for the chill body, provided it has relatively large mass so that it can act as a heat sink and absorb a considerable amount of heat. However, for longer runs, and especially if the chill body is a belt which has relatively little mass, cooling of the chill body is desirably provided. This may be accomplished conveniently by contacting it with cooling media which may be liquids or gases. If the chill body is chill roll, water or other liquid cooling medium may be circulated through it or air or other gases may be blown over it. Alternatively, evaporative cooling may be employed as by externally contacting the chill body with water or other liquid medium that provides cooling through evaporation.

Crucible and nozzle materials are chosen to withstand high temperatures and thermal shock, to not react with the molten metals and to permit fabrication without undue difficulty. Suitable materials include quartz, boron nitride, aluminum oxide, graphite and other refractory materials.

The configuration of the casting nozzle is of major importance in controlling the contour of ribbon prepared by planar flow casting. In particular, the nozzle plays an important role in controlling the amount and distribution of molten metal being provided for the ribbon, containing the casting puddle and molding the metal as it hardens. The nozzle of the present invention also controls the air flow over and around the molten metal puddle. This is accomplished by extending down toward the chill surface the leading edge of the first lip and the side edges at the bottom of the lips so that these edges are included in a first surface which is as close or closer to the chill surface than is any other point on the lips. The close proximity of the first surface to the chill surface (typically about 0.01 cm) reduces the air flow over the top and sides of the puddle, thereby providing smooth top surface and edges. In addition, reduced air flow reduces entrapment of air between the chill surface and the molten metal puddle, thus providing faster quench rate and yielding ribbon with fewer voids and with a smoother bottom surface.

Figure 2:
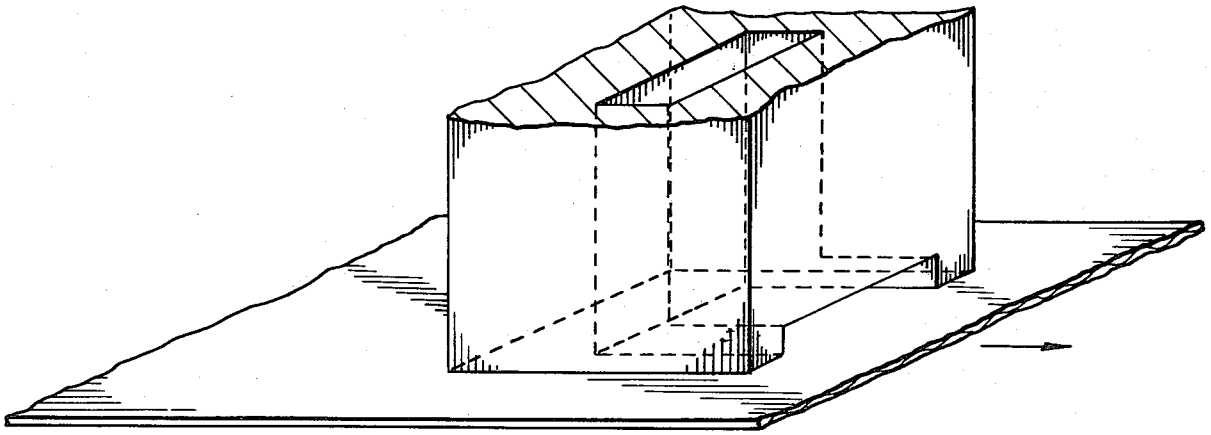
FIG. 2 is a perspective view of a nozzle of this invention and an adjacent chill surface.
Figure 3:
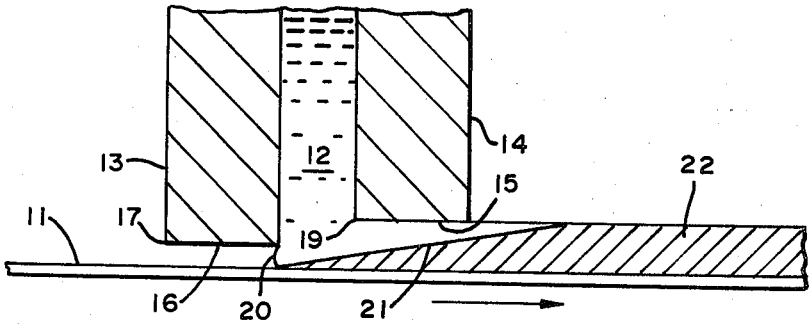
FIG. 3 is a side view in partial cross section illustrating planar flow casting of metal ribbon from a nozzle having a specific configuration relative to the chill surface in accordance with the present invention.

In one embodiment of the present invention, the bottom surface of the first lip is coplanar with the first surface; i.e., the surface that includes the leading edge of the first lip and the side edges at the bottom of the lips. FIG. 2 is a perspective view of this embodiment and of the adjacent chill surface. FIG. 3, a side view in partial cross-section, illustrates planar flow casting of metal ribbon from this embodiment. As shown in FIG. 3, a chill surface 11, here illustrated as a belt, travels in the direction of the arrow in close proximity to a slotted nozzle defined by a first lip 13 and a second lip 14. The nozzle's bottom surface 16 is substantially planar and includes the leading edge 17 of the first lip and the side edges 18 at the bottom of the lips (FIG. 4), but does not include the trailing edge of the slot 19. Another substantially planar surface 15 includes the trailing edge of the slot 19 and is at a greater distance from the belt than is the first planar surface 16. Molten metal 12 is forced under pressure through the nozzle to be brought into contact with the moving chill surface. The molten metal puddle has a rear surface meniscus 20. As the melt is solidified in contact with the surface of the moving chill body, a solidification front, indicated by line 21, is formed. A body of molten metal is maintained above the solidification front, while solidified strip 22 moves downstream and ultimately is separated from the chill surface.

Figure 4:
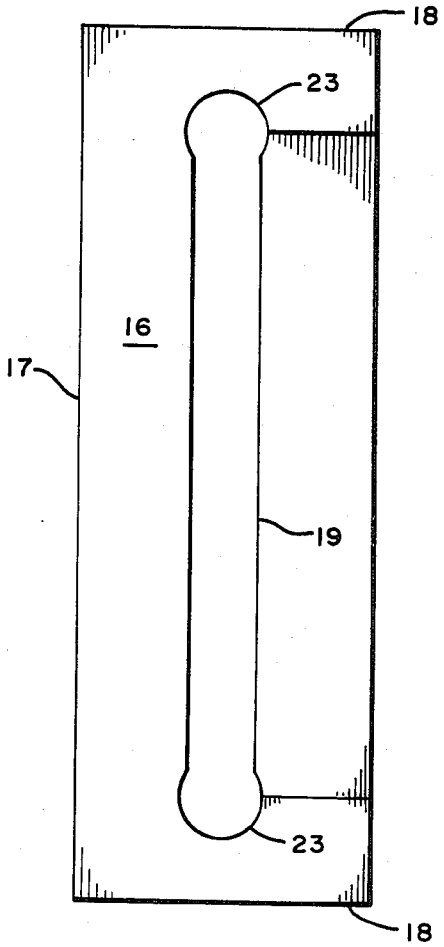
FIG. 4 is a bottom view of the nozzle shown in FIG. 3.

FIG. 4 is a bottom view of the nozzle of FIG. 3. As shown there, first planar surface 16 extends inward from side edges 18 to the widest part of lobed ends 23. Alternatively, surface 16 may extend inward only as far as the outer edges of lobed ends 23 or even less. When a rectangular slot is employed instead of lobed ends, the amount of molten metal available at the edges of the ribbon may be less than at the center. The lobed slot configuration would then be preferred in order to provide adequate metal to the edges for uniform ribbon cross section.

In a preferred embodiment of this invention, at least part of the bottom surface of the first lip is not parallel to the chill surface. The reason is that the position of the rear surface of the meniscus 20 is not uniquely located when the bottom surface of the first lip 16 is a plane parallel to the chill surface 11, with a constant gap between the two surfaces. For a given gap between lip and chill surface, there is a range of "permissible" pressures (in the molten metal) for which the meniscus will not be forced to move. This range is between a lower critical pressure and an upper critical pressure and is tabulated below for typical gaps. Thus, if the initial casting conditions cause the meniscus to locate at any point between the leading edge of the first lip and the leading edge of the slot, there is no tendency for the meniscus to move, as long as the pressure is within the permissible range for that gap. Likewise, if the meniscus is moving—due, perhaps, to factors other than pressure—there is no tendency for it to stop until it reaches one end of the first lip or the other.

TABLE

| Gap (cm) | Critical Pressures (kPa) Lower | Upper |
|---|---|---|
| 0.0025 | 21.2 | 69.0 |
| 0.005 | 10.6 | 34.5 |
| 0.010 | 5.31 | 17.2 |
| 0.020 | 2.62 | 8.62 |
| 0.0254 | 2.07 | 6.83 |
| 0.0381 | 1.38 | 4.55 |

In those nozzles of the present invention in which at least part of the bottom surface of the first lip is not parallel to the chill surface, the gap is not constant. As a result, if the meniscus moves, it may encounter a gap for which the permissible pressure range does not include the actual pressure. The meniscus will then be stopped and forced in the opposite direction until it reaches a gap whose range does include the actual pressure. These nozzles thus provide a kind of "restoring force" which restricts meniscus excursions. In order to contain the meniscus, and also to minimize the effect of air flow over the molten metal, the leading edge of the first lip is positioned as close to or closer to the chill surface than any other point on the nozzle.

The nonparallel (second) surface, which provides the restoring force, can take a variety of forms. A surface substantially perpendicular to the chill surface can join two surfaces parallel to the chill surface at different distances from the chill surface. Depending on the magnitude of the gaps and pressures, this perpendicular surface can stop the motion of a moving meniscus, which would continue to an extreme end of a prior art "single-gap" first lip. In a more preferred embodiment, the nonparallel surface of the first lip is a plane inclined to the plane of the chill surface; preferably making an angle of about 5° to about 45° with the chill surface. The inclined surface can connect the first surface and a planar (third) surface or, preferably, the inclined surface can connect the leading edges of the first lip and the slot. An advantage of the inclined surface is that it provides a continuously varying gap with a corresponding continuous variation in permissible pressure range. The parameters of the inclined surface (i.e., gap, incline angle, extent of inclined surface etc.) are chosen to minimize the meniscus excursion range for the pressures to be used.

Figure 5:
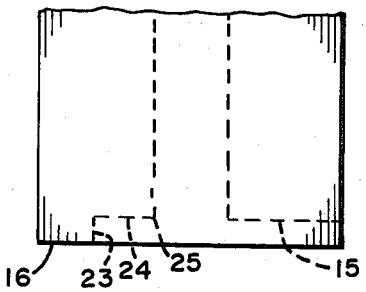
FIGS. 5, 7, 9, 11, 13 and 15 are side views and FIGS. 6, 8, 10, 12, 14 and 16 the corresponding bottom views, respectively, of additional embodiments of nozzles of this invention.
Figure 6:
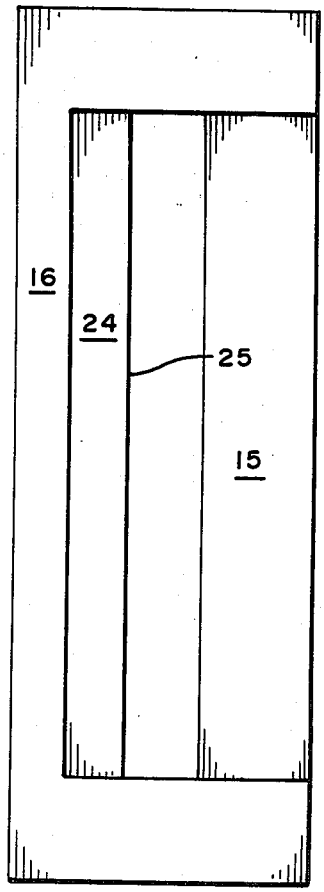

FIGS. 5 and 6 show side and bottom views, respectively, of a nozzle of the present invention, wherein the bottom of the first lip includes a surface 23 which is not parallel to the chill surface. In addition, the bottom of the first lip includes a substantially planar (third) surface 24, which includes the leading edge of the slot 25, is substantially parallel to the chill surface and is a greater distance from the chill surface than is the first planar surface 16. Surfaces 24 and 15 of the first and second lips, respectively, are shown to be substantially coplanar in FIG. 5, but coplanarity is not necessary. For simplicity, a rectangular slot cross section is shown in FIG. 6 as well in FIGS. 8, 10, 12, 14 and 16. However, as discussed earlier, a lobed slot may be used instead and surface 16 need not extend inward as far as the ends of the slot.

Figure 7:
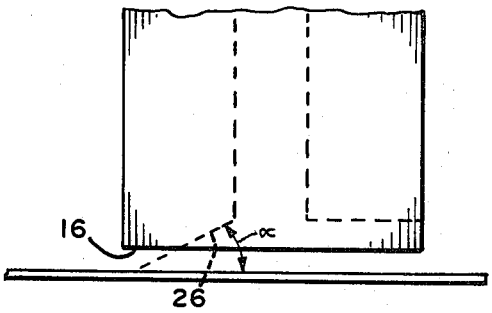
Figure 8:
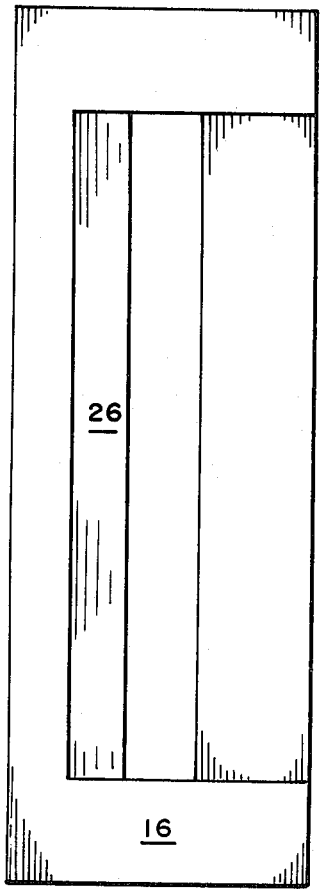

FIGS. 7 and 8 show side and bottom views, respectively, of a nozzle of another embodiment of the present invention, wherein the bottom surface of the first lip includes, in addition to first planar surface 16, a substantially planar second surface 26, which includes the leading edge of the slot and is not parallel to the chill surface. Second surface 26 forms an angle $\alpha$ with the plane of the chill surface. Preferably, $\alpha$ is between about 5° and 45°.

Figure 9:
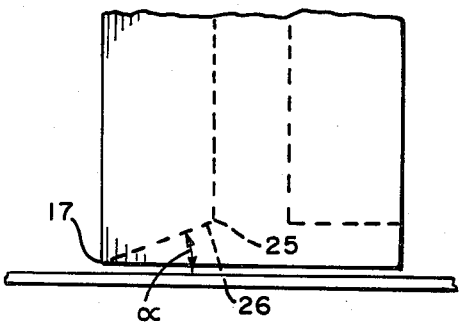

In another embodiment of this invention, the first lip includes, in addition to first planar surface 16, a substantially planar second surface, including leading edge 17 of the first lip and leading edge 25 of the slot and forming an angle $\alpha$ of about 5° to about 45° with the plane of the chill surface. An example of this embodiment is shown in a side view in FIG. 9 and a bottom view in FIG. 10. A feature of this embodiment is that the second surface of the first lip provides an upper contact for the upstream meniscus over a continuous range of chill surface-lip distances between the leading edge of the lip and the leading edge of the slot.

Figure 11:
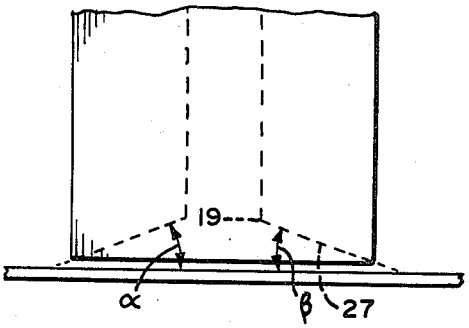
Figure 10:
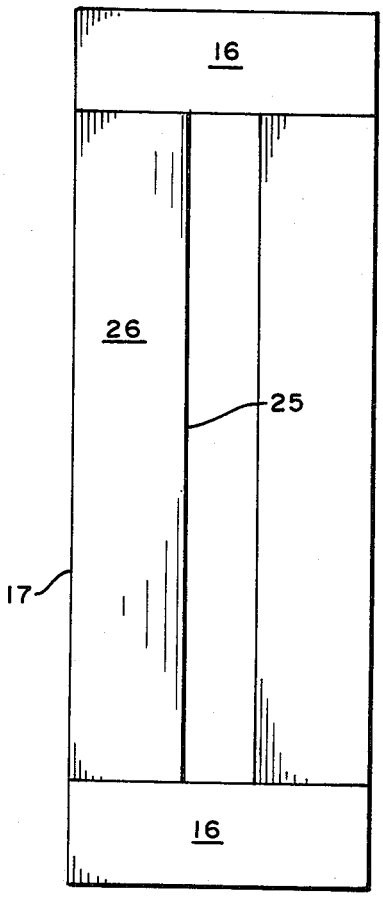
Figure 12:
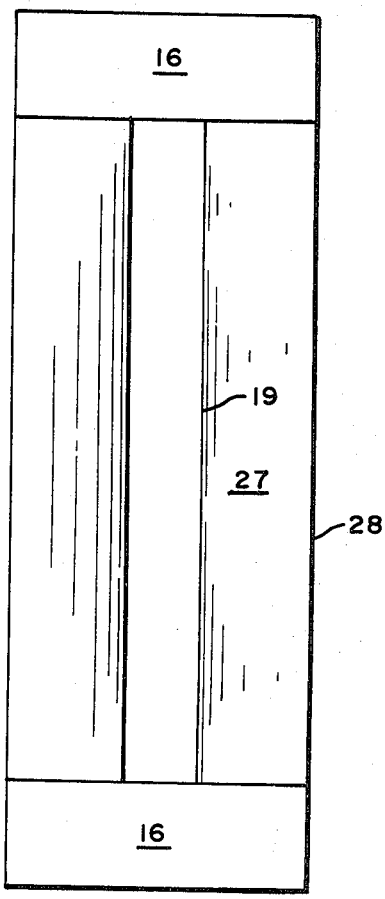

FIGS. 11 and 12 show side and bottom views, respectively, of another embodiment of this invention, wherein the bottom plane of the second lip includes, in addition to first planar surface 16, a substantially planar second surface 27, which includes the trailing edges of the slot 19 and second lip 28. The second surface forms an angle $\beta$ of about 5° to about 45° with the plane of the chill surface, the gap increasing toward the slot. Although the nozzle shown in FIGS. 11 and 12 has a second surface of the first lip forming with the chill surface an angle similar to that formed by the second surface of the second lip, this is not a requirement, and the first lip may, in addition to first planar surface 16, comprise one or more surfaces, which may or may not be parallel to the chill surface. A feature of this embodiment is that the bottom surface of the second lip molds the soft top layer of ribbon, either by physical contact or through an intervening air layer.

Figure 13:
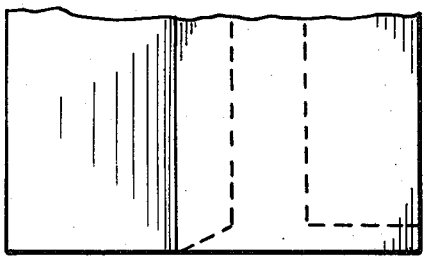
Figure 14:
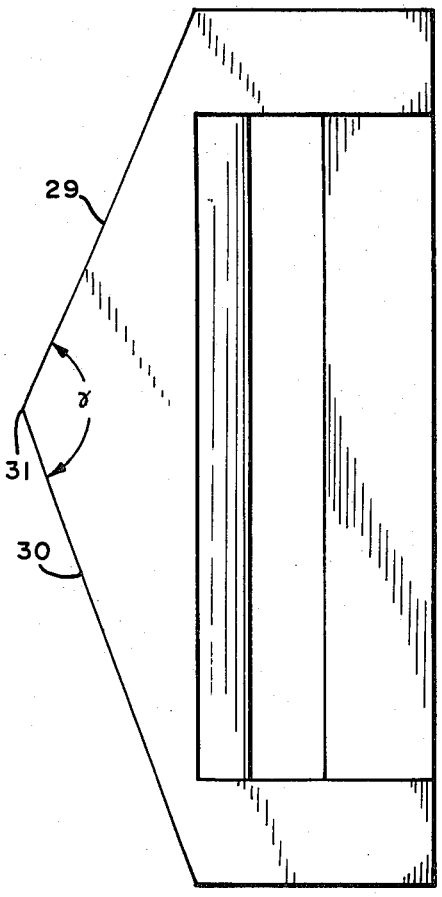

FIGS. 13 and 14 show side and bottom views, respectively, of another embodiment of this invention, wherein the leading edge of the first lip comprises two straight lines 29 and 30 of substantially equal length which meet at the front 31 of the leading edge to form an angle $\gamma$, which is preferably between about 90° and about 150°. The V-shaped leading face of this nozzle directs air away from the slot and helps to reduce undesirable air entrapment and turbulence.

Figure 15:
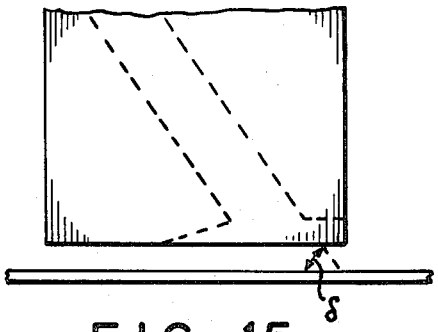
Figure 16:
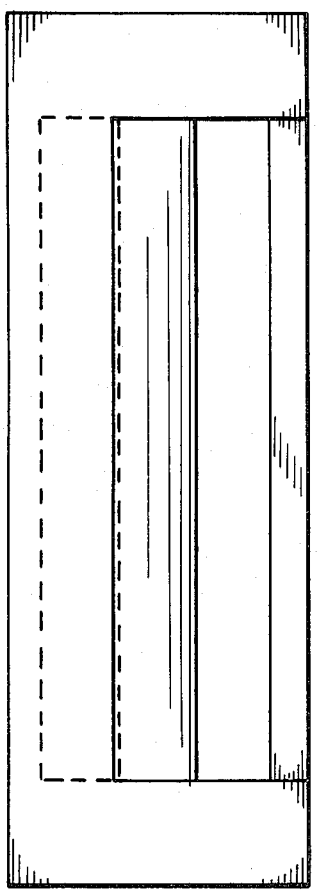

The slot that separates the lips preferably comprises leading and trailing (i.e., upstream and downstream) surfaces which are substantially planar and parallel. These surfaces may form an angle $\delta$ of about 30° to about 90° with the plane of the chill surface, the slot exit pointing in the direction of motion of the chill surface. An example of this embodiment is shown in FIGS. 15 and 16. By providing to the molten metal a component of velocity in the direction of motion of the chill surface as it leaves the slot, this embodiment further reduces the tendency of air turbulence to produce waviness and other undesirable patterns in the upper surface of the molten metal puddle.

The apparatus of the present invention is suitable for forming polycrystalline ribbon of aluminum, tin, copper, iron, steel, stainless steel and the like.

Metal alloys that, upon rapid cooling from the melt, form solid amorphous structures are preferred. These are well known to those skilled in the art. Examples of such alloys are disclosed in U.S. Pat. Nos. 3,427,154; 3,981,722 and others.

We claim:

1. An apparatus for planar flow casting of metal ribbon comprising a movable chill surface, a reservoir for holding molten metal and a nozzle in communication at its top with the reservoir and having at its bottom two lips adjacent to the chill surface, a first lip and a second lip numbered in the direction of movement of the chill surface, wherein (a) the lips are separated by and define a slot for depositing molten metal on the chill surface;

(b) the leading and trailing edges of the slot are substantially parallel, to each other and are generally perpendicular to the direction of movement of the chill surface;

(c) the bottom of the lips comprises at least two non-coplanar surfaces, including a substantially planar first surface substantially parallel to the chill surface, said first surface including the leading edge of the first lip and the side edges at the bottom of the lips but not including the trailing edge of the slot;

(d) the first surface is separated from the chill surface by at least about 0.20 mm; and (e) all points on the bottom of the lips are at least as far from the chill surface as is the first surface, but are no further from the chill surface than about 1 mm.

2. The apparatus of claim 1 wherein at least part of the bottom surface of the first lip is a second surface which is not parallel to the chill surface.

3. The apparatus of claim 2 wherein the second surface of the first lip includes the leading edge of the first lip.

4. The apparatus of claim 2 wherein the angle between the second surface of the first lip and the chill surface is about 5° to about 45°.

5. The apparatus of claim 2 wherein the bottom of the first lip includes a substantially planar third surface, which includes the leading edge of the slot, is substantially parallel to the chill surface and is at a greater distance from the chill surface than is the first surface.

6. The apparatus of claim 1 wherein the bottom of the second lip includes a substantially planar second surface which includes the trailing edges of the slot and the second lip and no point on the second surface of the bottom of the second lip is farther from the chill surface than is the trailing edge of the slot.

7. The apparatus of claim 6 wherein the angle between the second surface of the bottom of the second lip and the chill surface is about 5° to about 45°.

8. The apparatus of claim 1 wherein the leading edge of the first lip comprises two straight lines of substantially equal length which meet at a point at the front of the leading edge.

9. The apparatus of claim 1 wherein the leading and trailing surfaces of the slot separating the lips comprise two substantially parallel planes which form an angle of about 30° to about 90° with the plane of the chill surface, the slot exit pointing in the direction of motion of the chill surface.

* * * * *

UNITED STATES PATENT AND TRADEMARK OFFICE

CERTIFICATE OF CORRECTION

PATENT NO. : 4,290,476

DATED : September 22, 1981

INVENTOR(S) : Robert W. Smith, et al.

It is certified that error appears in the above-identified patent and that said Letters Patent are hereby corrected as shown below:

Column 1, line 23, after "molten", it should read --metal--.

Claim 1, Column 7, line 25, delete ","

Column 7, line 28, "now" should be --non--

Column 7, line 35, "0.20" should be --0.02--

Signed and Sealed this

*Twelfth* Day of *January 1982*

[SEAL]

*Attest:*

GERALD J. MOSSINGHOFF

*Attesting Officer*

*Commissioner of Patents and Trademarks*